US009122292B2

(12) United States Patent
Pan et al.

(10) Patent No.: US 9,122,292 B2
(45) Date of Patent: *Sep. 1, 2015

(54) LDO/HDO ARCHITECTURE USING SUPPLEMENTARY CURRENT SOURCE TO IMPROVE EFFECTIVE SYSTEM BANDWIDTH

(71) Applicant: SanDisk Technologies Inc., Plano, TX (US)

(72) Inventors: Feng Pan, Fremont, CA (US); Sung-En Wang, San Jose, CA (US); Jiang Yin, San Jose, CA (US)

(73) Assignee: SanDisk Technologies Inc., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/750,794

(22) Filed: Jan. 25, 2013

(65) Prior Publication Data

US 2014/0159682 A1 Jun. 12, 2014

Related U.S. Application Data

(60) Provisional application No. 61/734,880, filed on Dec. 7, 2012.

(51) Int. Cl.

| | |
|---|---|
| ***G05F 1/573*** | (2006.01) |
| ***G05F 1/575*** | (2006.01) |
| ***G05F 1/10*** | (2006.01) |

(52) U.S. Cl.

CPC . *G05F 1/575* (2013.01); *G05F 1/10* (2013.01)

(58) Field of Classification Search

CPC ..... G05F 1/56; G05F 1/565; G05F 1/573; G05F 1/575; H02M 3/156; H02M 2001/0045

USPC ..... 323/271, 273–281

See application file for complete search history.

(56) References Cited

U.S. PATENT DOCUMENTS

| | | | |
|---|---|---|---|
| 5,841,270 | A | 11/1998 | Do et al. |
| 6,144,195 | A | 11/2000 | Afghahi et al. |
| 6,518,737 | B1 | 2/2003 | Stanescu et al. |

(Continued)

FOREIGN PATENT DOCUMENTS

EP 0864956 A2 9/1998

OTHER PUBLICATIONS

"500mA CMOS LDO Regulator," Catalyst Semiconductor, Inc., CAT6219, May 20, 2008, 10 pages.

*Primary Examiner* — Matthew Nguyen

*Assistant Examiner* — Kevin H Sprenger

(74) *Attorney, Agent, or Firm* — Davis Wright Tremaine LLP

(57) ABSTRACT

An LDO/HDO circuit adds a supplementary current source to supply the output node. The current boosting section includes a digital comparator with a first input connected to the LDO's feedback loop and a second input connected to a reference level. The comparator then generates a digital output used to control the supplementary current source. This approach also can be used in a far-side implementation, where the local supply level for the load is boosted by the current source based a comparison of this local level and the output of the LDO. Miller capacitive compensation is also considered. Current in shunted to ground from a node in the Miller loop, where the level is controlled by the output of a digital comparator base on a comparison of the circuit's output voltage and a reference level.

9 Claims, 4 Drawing Sheets

(56) References Cited

U.S. PATENT DOCUMENTS

| | | | | |
|---|---|---|---|---|
| 6,700,360 | B2 | 3/2004 | Biagi et al. | |
| 7,142,045 | B2 * | 11/2006 | Mo et al. | 327/541 |
| 7,323,853 | B2 | 1/2008 | Tang et al. | |
| 7,362,081 | B1 | 4/2008 | Huang | |
| 7,391,196 | B2 | 6/2008 | Fosler | |
| 7,612,548 | B2 | 11/2009 | Jian | |
| 7,714,553 | B2 | 5/2010 | Lou | |
| 8,004,253 | B2 | 8/2011 | Beltran | |
| 8,716,993 | B2 * | 5/2014 | Kadanka | 323/274 |
| 2002/0060560 | A1 | 5/2002 | Umemoto | |
| 2003/0011350 | A1 * | 1/2003 | Gregorius | 323/282 |
| 2003/0111986 | A1 | 6/2003 | Xi | |
| 2004/0021450 | A1 | 2/2004 | Wrathall | |
| 2004/0164789 | A1 | 8/2004 | Leung et al. | |
| 2005/0184713 | A1 | 8/2005 | Xu et al. | |
| 2006/0170404 | A1 | 8/2006 | Amrani et al. | |
| 2006/0250825 | A1 | 11/2006 | Grigore | |
| 2008/0180074 | A1 | 7/2008 | Einerman et al. | |
| 2008/0203981 | A1 | 8/2008 | Itoh et al. | |
| 2009/0001953 | A1 | 1/2009 | Huang | |
| 2009/0033310 | A1 | 2/2009 | Erbito, Jr. | |
| 2009/0102444 | A1 | 4/2009 | Nonaka | |
| 2009/0224827 | A1 | 9/2009 | Tadeparthy et al. | |
| 2009/0302812 | A1 | 12/2009 | Shor et al. | |
| 2010/0156379 | A1 * | 6/2010 | Marino et al. | 323/293 |
| 2011/0121802 | A1 | 5/2011 | Zhu | |
| 2012/0187930 | A1 * | 7/2012 | Williams et al. | 323/273 |
| 2014/0117958 | A1 * | 5/2014 | Price et al. | 323/281 |

* cited by examiner

LDO/HDO ARCHITECTURE USING SUPPLEMENTARY CURRENT SOURCE TO IMPROVE EFFECTIVE SYSTEM BANDWIDTH

CROSS-REFERENCE TO RELATED APPLICATION

This application claims priority to and the benefit of U.S. Provisional Application No. 61/734,880, filed Dec. 7, 2012, and is related to U.S. patent application Ser. No. 13/750,808, filed Jan. 25, 2013, entitled "Settling Time and Effective Band Width for Op-Amps Using Miller Capacitance Compensation," which applications are incorporated herein in their entirety by this reference.

FIELD OF THE INVENTION

This invention pertains generally to the field of voltage regulation circuits and, more particularly, to low drop out (LDO/HDO) voltage regulators and operational amplifiers using Miller capacitance compensation.

BACKGROUND

Voltage regulation circuits have many applications in power supply systems to provide a regulated voltage at a predetermined multiple of a reference voltage. In low drop-out regulator designs, power supply drop-out can be an issue due to higher frequency switching, load dump and higher power consumption. Two of the issues that can arise from high frequency operations are start-up settling time specification and steady state supply load dump recovery specification. There is consequently room for improvement in the design of low drop out regulation circuits.

In LDO design, using Miller capacitance compensation techniques in feedback control loop can be an effective approach to achieve stability while using less silicon area for a design. One of the drawbacks of using Miller capacitance compensation is the existence of two closed feedback loops for the Op-amp. Normally, under a small signal model there is only one closed feedback loop, namely that from the op-amp's output through the feedback network, and then through the error amplifier to the final output. This known engineering effect is used to improve the circuit's bandwidth and stability. However, if output of the op-amp is significantly disturbed, such as is the case when connecting to a load or when the load has fast switching characteristics, then a second closed loop formed from the output through the miller capacitance directly to the output of error amplifier and then on to the output of the op-amp. This second closes loop will dominate over the normal closed loop due to its high frequency nature as the Miller capacitance is acting as short circuit at high frequencies. The combined result of the fast closes loop plus original closes loop is a longer settling time due to the slew rate of error amplifier, basically, a dominant pole exists under this transition at output of error amplifier. In LDO designs using dominant pole compensation at the output of LDO, this will improve Power Supply Rejection Ratio (PSRR) over the entire frequency range, but will use large amounts of power and relatively large silicon area for physical capacitance. This type of compensation scheme limits the circuit's dynamic performance due to its slew rate in initial settling time and steady state load dump recovery speed.

SUMMARY OF THE INVENTION

According to a general aspect of the invention, a voltage regulator circuit is presented. The regulator includes a power transistor, connected between an input supply voltage and an output supply node, and an error amplifier having a first input connected to receive a first reference voltage and a second input connected to a feedback node. The error amplifier provides an output derived the inputs to control the gate of the power transistor. A voltage divider circuit is connected between the output node and ground, and the feedback node taken from a first node of the voltage divider. A current source circuit is connected between the input supply voltage and the output supply node. A comparator has a first input connected to receive a second reference voltage and a second input connected to a second node of the voltage divider and derive a digital output from these inputs. The comparator's output is connected to the current source circuit, where the magnitude of the current provided to the output supply node is based on the comparator's output.

Another general aspect of the invention presents voltage regulation circuitry for supplying a load on an integrated circuit. The voltage regulation circuitry includes a voltage generation section and a supplementary current source section. The voltage generation section includes a power transistor connected between an input supply voltage and a first output supply node; an error amplifier having a first input connected to receive a reference voltage and a second input connected to a feedback node, the error amplifier providing an output derived from the inputs connected to control the gate of the power transistor; and a voltage divider circuit connected between the output node and ground, the feedback node taken from a node of the voltage divider. The supplementary current source section includes: a current source circuit connected between the input supply voltage and a second output supply node, the load being connected between the first and second output supply nodes; and a comparator having a first input connected to the first output supply node and a second input connected to the second output supply node, the comparator deriving a digital output from the first and second inputs. The comparator's output is connected to the current source circuit, where the current provided to the second output supply node is based on the comparator's output and the size of pass transistor. (For example, the current source can be implemented as a pass transistor and then the magnitude and duration current provided to the second supply node is based on the comparator's output and the size of the pass transistor.)

Other aspects present a voltage regulation circuit having a power transistor, connected between an input supply voltage and an output supply node and an error amplifier having a first input connected to receive a first reference voltage and a second input connected to a feedback node, the error amplifier providing an output derived from the inputs connected to control the gate of the power transistor. A voltage divider circuit is connected between the output node and ground, where the feedback node taken from a first node of the voltage divider. A capacitor and resistor are connected in series between the output supply node and the output of the error amplifier. A current sinking circuit is connected between ground and a node between the capacitor and the resistor, and a comparator having a first input connected to receive a second reference voltage and a second input connected to the output supply node. The comparator provides a digital output derived from its inputs that is connected to the current source circuit, where the magnitude of the current provided to the output supply node is based on the comparator's output.

Various aspects, advantages, features and embodiments of the present invention are included in the following description of exemplary examples thereof, whose description should be taken in conjunction with the accompanying drawings. All patents, patent applications, articles, other publications, documents and things referenced herein are hereby incorporated herein by this reference in their entirety for all purposes. To the extent of any inconsistency or conflict in the definition or use of terms between any of the incorporated publications, documents or things and the present application, those of the present application shall prevail.

DETAILED DESCRIPTION

The following looks at techniques for helping with the problems discussed in the Background by introducing a comparator and a current source. First a pair of embodiments for case of an LDO/HDO are considered, starting with an example using supplementary current source for low output voltage detection followed by looking at far-side regulated supply drop-off detection and current boosting. After these, a section looks at operational amplifiers using Miller capacitance compensation.

LDO: Current Boost by Low Voltage Detection

This section considers drop-out at the voltage regulator and the next addresses drop-out far away from the regulator. Supply drop-out can occur during start-up due to the fact that the regulator is slewing its compensation capacitance before reaching steady state. Steady state drop-out recovery can occur during high load dump operation, as the regulator bandwidth is typically smaller than the inverse of the time constant of the load dump operations; therefore, regulator responds slowly in time due to slewing in large signal response. Another set of concerns are from worst-case drop-out corners, when supply drops due to parasitic IR drop: For this last case, adding another LDO can solve the problem, but at a high area/routing cost.

One approach to dealing with these problems is by boosting bandwidth by using tail current control. This increases the overall LDO/HDO bandwidth with higher power consumption. The higher bandwidth directly relates to faster recovery. This approach has the advantage of being easily implementable, but also has several disadvantages. A first is that the maximum bandwidth is limited by the gain bandwidth product of the open loop circuit. There is also a maximum tail current that can be supplied before the tail current transistor enters linear region. Further, as bandwidth increases, the phase margin suffers degradation from non-dominant poles and system could suffer stability issue.

Another approach to improve startup time is to equalize both op-amp inputs to a fixed voltage, so that once the regulator exits stand-by operation the current drawn from both paths are equal so that the time in feedback network delay and voltage slewing during start-up phase is reduced. This approach has the advantage of only needing two transistors to implement; however, it has the disadvantage of a large phantom zero capacitance that can slow recovery to the final supply value.

Figure 1:
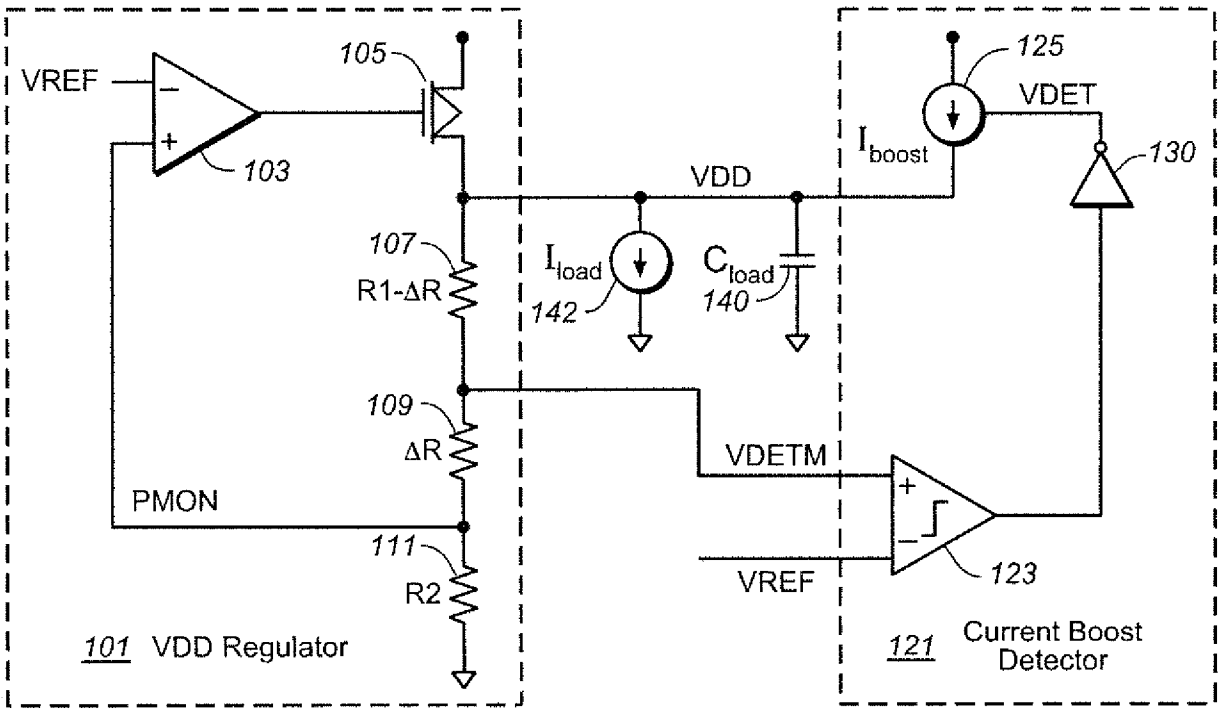
FIG. 1 is an exemplary embodiment of a hybrid LDO circuit including a current boost detector.

The circuits of this section and the next present exemplary embodiments that can help solve these start-up and recovery problems for LDOs. FIG. 1 is a schematic representation employing supplementary current source by low voltage detection. The left side of FIG. 1 is a typical LDO and includes a power transistor 105 connected between the supply level and the output node to provide VDD to a load, here represented by $C_{load}$ 140 and a current $I_{load}$ 142 load current). The control gate of the power transistor 105 is connected to the error amp 103 whose inputs are a reference voltage VREF and a feedback value PMON. The feedback PMON is taken from a node of a resistive divider connected between the VDD node and ground. The PMON level is taken from between R1 (here split into R1-ΔR) 107 and ΔR 109) R2 111.

To the right of FIG. 1 is a supplementary Current Boost Detector section 121 that together with the VDD regulator system make up the system circuit. A current source 125 is connected between the supply and the output node to supply a current $I_{boost}$ to the load. The current source 125 is controlled by the output VDET of comparator 123 based on the input VDETM and reference voltage VREF. Here, as indicated on the figure, the comparator 123 provides a digital output VDET that is provided through the buffering circuitry 130, as discussed further with respect to FIG. 2. Digital circuitry has higher bandwidth than that of analog circuits. The purpose the digital current boost section 121 is to assist the LDO/LIDO of section 101 with fast response in both start-up and steady state recovery to limit the magnitude of the large signal downward swing on the output. As VDD drops, VDETM drops and VDET transitions from low to high. This causes $I_{boost}$ to be injected to $C_{load}$, so that VDD recovers. In startup, with limited downward swing, the LDO/HDO does not need to be designed with high bandwidth that would burn unnecessary power. In steady state, limiting the downward voltage swing on output reduces the effective voltage LDO needs to slew, which effectively increases its bandwidth that under normal conditions it could not achieved due to technology limitation, power limitation and small signal stability requirement.

As for the detector loop delay constraint, the amount of voltage overshoot on VDD can be expressed as the following:

$$I_{boost} = C_{load}\frac{V_{overshoot}}{t_d} \rightarrow t_d = \frac{C_{load}V_{overshoot}}{I_{boost}}.$$

For example:

$$\begin{aligned} C_{load} &= 200\text{pF} \\ V_{overshoot} &< 100\text{mV} \xrightarrow{yields} t_d < 4nS \\ I_{boost} &= 5\text{mA} \end{aligned}$$

The current source for supplying $I_{boost}$ can be implemented using either p-channel or n-channel devices. The current source can either include or not include current limiting. This equation is related to how much overshoot could occur, where the difference between VDETM and VREF is how much output downswing is wanted to be limited on output. This voltage determines two things: First, this difference voltage is in startup before the LDO can respond, and is how low of an output the system can accept due to design specification;

second this difference voltage in steady state is how much voltage difference is wanted for the main LDO/HDO to response as a small signal response, rather than large signal response. Since a large signal response triggers slewing of compensation capacitance, it would be very slow compared with small signal response of the op-amp.

Figure 2:
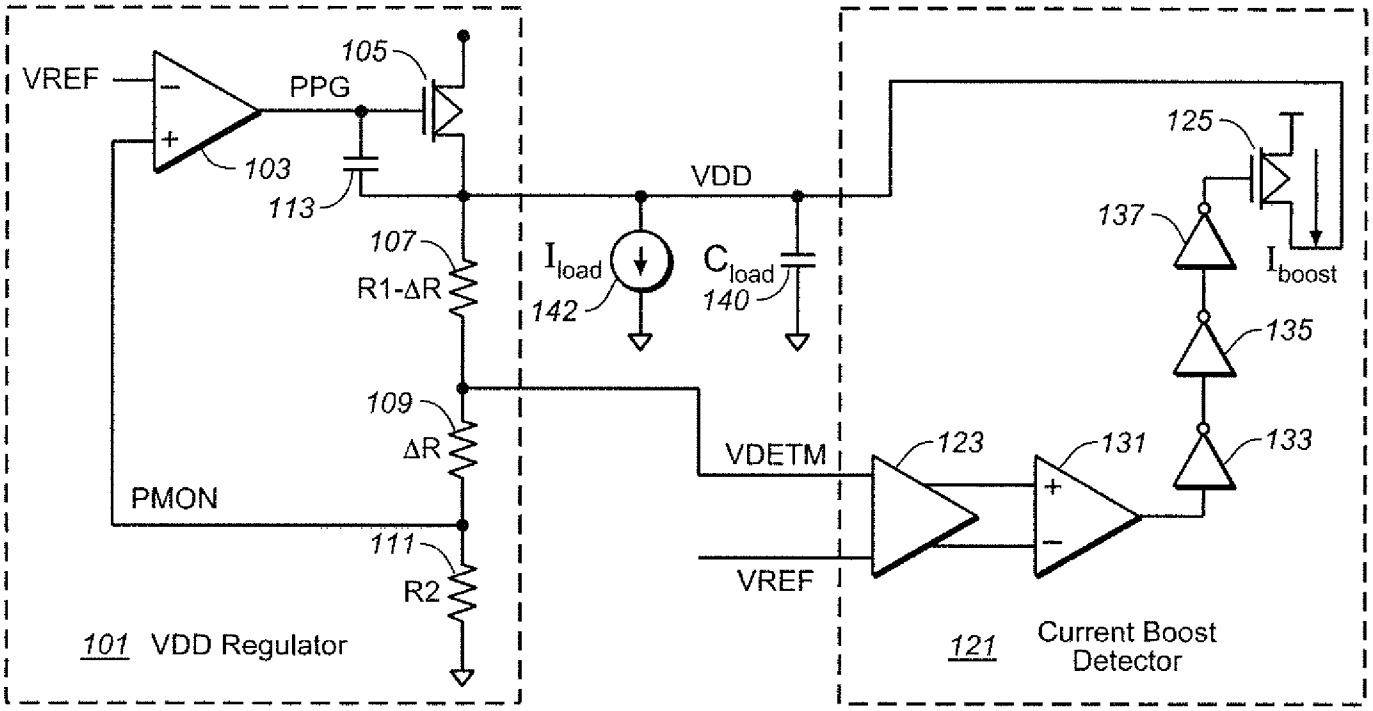
FIG. 2 is a more detailed version of FIG. 1.

FIG. 2 adds some additional detail to FIG. 1 for an exemplary embodiment. Here the current source 125 is implemented as a transistor connected between the supply level and the VDD node whose gate is controlled by the VDET level. The buffer circuitry is an op-amp 131 connected in series with three invertors 133, 135, 137. The hybrid LDO system has the convention LDO VDD regulation section 101 as well as the digitally assisted section 121, each providing a corresponding closed loop. The analog compactor and digital buffering are again preferably used to achieve the highest bandwidth under the given technology. The two closed loops combine to form the overall closed loop response for low drop out regulation: the slow loop determines overall stability, while the fast loop determines the response time and drop out if a large swing occurs on the output. (The embodiment of FIG. 2 also includes an optional Miller capacitive compensation 131, such as discussed further below.) The buffers can be treated here as part of the comparator 123, where the digital buffering is again preferred if the pass transistor is a large load relative to the comparator's output.

LDO: Far Side Regulated Supply Drop-Off Detection and Current Boosting

This section looks at the case where a current boosting section, or a supplementary current source, is again added to the more typical LDO circuit to supply a regulated voltage, but rather than being part of the LDO system to provide the supply output to a load, the current boosting section is now a "far side" arrangement that is placed at a location remote from the VDD generating circuit. This sort of arrangement is illustrated schematically in FIG. 3.

A voltage generating section VDDGEN 201 provides a regulated level of VDD. Here VDDGEN 201 can be any sort of LDO, such as in section 101 of FIG. 1, of another design, or sort of the hybrid system of FIG. 1 including the supplementary current source section 121. The regulated supply level VDD is then provided to a load 240, here represented as a set of current draws connected between the supply level and ground in series between resistances. For instance, the load could be part of a flash or other non-volatile memory system which the voltage supply is part of the peripheral circuitry. The far side current boosting circuitry is shown to the upper left of FIG. 3.

Figure 3:
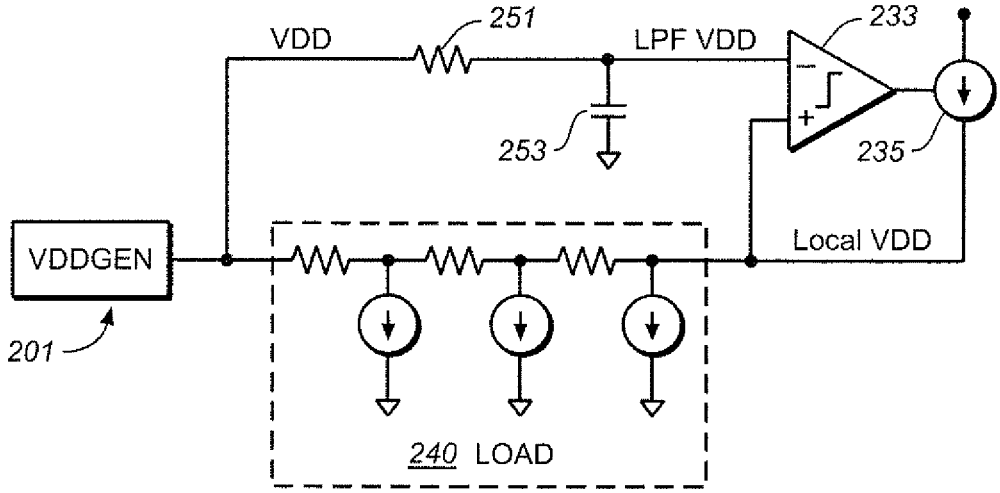
FIG. 3 is an exemplary embodiment of a far side implementation a current boost detector.

The circuit now routs a separate VDD line from VDDGEN 201 to the far side of the chip. At the far side of the chip, a comparator 223 is used to compare the local VDD as seen at the load (Local VDD) and the VDD level from VDDGEN 201. As indicated in the FIG. 3, the comparator of the exemplary embodiment again supplies a digital output to the current source. The resistances and capacitances that occur along this routing are respectively represented at 251 and 253. Due to losses along the way, the second input to the comparator 233 is LPF VDD. The output of the comparator 233 is then used to the control the current source 235 connected between the high supply level and the Local VDD node. If the Local VDD is lower than VDD from VDDGEN 201 by a certain level, the current source 235, which can again be implemented as a PFET pass transistor, turns on and charges the Local VDD node on the far side of the load. The output of the pass transistor of 235 is then based on the difference at the inputs of the comparator 233 and also the size of the pass transistor. Although only a single far side boosting circuit is shown in FIG. 3, multiple ones of these can be added to the circuit as needed. As the far side boosting circuit does not need any resistor digital-to-analog conversion, decoding circuitry, or compensation capacitors, the area of the detector can significantly smaller than a supply regulator. Far side boosting could also use local feedback if the overall power can be optimized to be smaller while achieving better performance.

Figure 4:
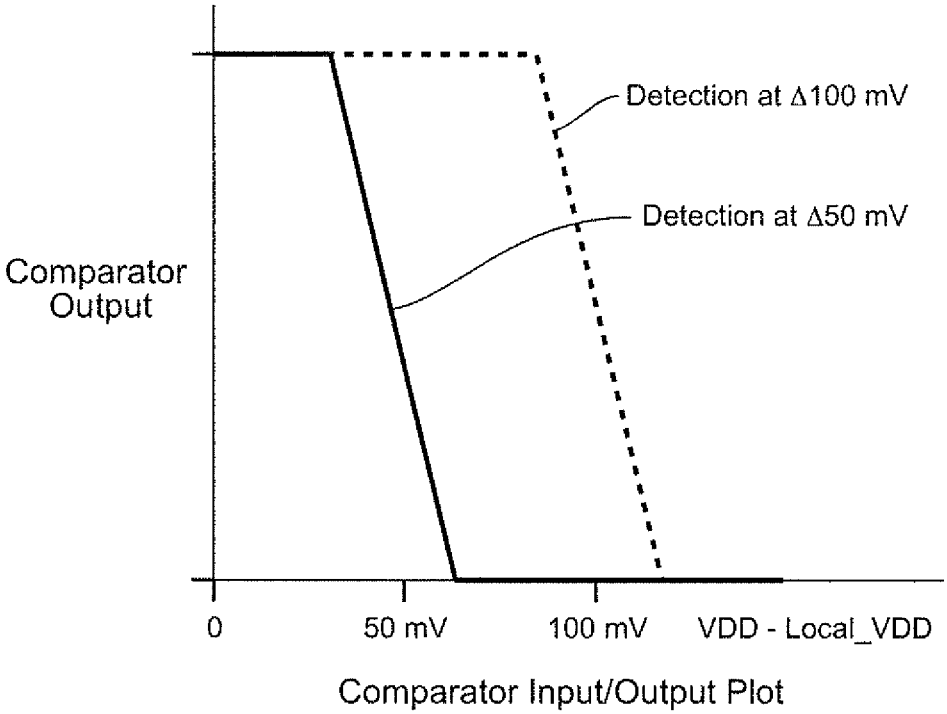
FIG. 4 illustrates a comparator input/output plot incorporating skewing.

Considering comparator requirements, the comparator 233 is preferably skewed. If the comparator is not skewed, any small amount of noise can trigger the current pulse from the source 235. This can lead to unwanted ripple at the regulated supply. FIG. 4 illustrates an example of the DC Output/Input curve of a comparator skewed by 50 mV and 100 mV.

Both the far side embodiments of this section and the case of the last section, where the supplementary current source circuitry is part of the regulated output supply system, have a number of advantages. Either scheme can increase the effective bandwidth of the whole system and reduce the design difficulties (power, bandwidth, area of main LDO, and so on). Either scheme can both improve start-up and steady state drop-out recovery. Also, neither scheme changes the stability of the parallel supply regulator. There is no need to change compensation network circuit and the arrangement is easy on design requirement. These arrangements can help to eliminate the drop-out at far side, also reducing the drop-out due to having no IR drop across the supply routing channel. The area of either design is small compared to the typical circuit's analog block and there is more flexibility in placing the design block at an effective location.

Improvement in Power Consumption, Area, Settling Time and Effective Band Width for OPAMP using Miller Capacitance Compensation with Large Signal Disturbance on Output This section considers techniques to significantly improve power consumption, area settling time and the effective band width for operational amplifiers using Miller capacitance compensation. In particular, this section introduces a technique to remove current injected in a fast closed loop and kill this newly formed closed loop through the Miller capacitance. This allows the op-amp to have significantly improved settling speed, which under normal conditions would not be achieved by same op-amp without sacrificing power, area, bandwidth or technology limitations.

The use of Miller capacitance compensation for operational amplifiers to improve stability and phase margin is a popular technique due to a number of advantages that it provides. One of these is a smaller die size impact due to effective large capacitance size of $(1+Av)*Cc$, where Av is the voltage gain of the op-amp, while the physical capacitor size of the Miller capacitance is only Cc. Miller capacitive compensation also has advantages with respect to ole splitting and overall higher op-amp bandwidth compared with other compensation schemes.

One of the drawbacks for op-amps using Miller capacitive compensation is settling time. It is difficult to improve settling time due to the existence of two closed loops, where the fastest feed-backward loop is through Miller capacitance to the output of error amplifier, which can overwhelm the original closed loop for the op-amp. The effect of transient responses is a longer ringing of signal of interests and slow settling times during load dump operations.

Figures of merits for op-amps include gain, area, bandwidth, power supply rejection ratio, settling speed, power, and area. This techniques presented in this section primarily address settling speed, bandwidth, and power and area efficiency when using Miller capacitive compensation, significantly improving these figures of merit, while not disturbing any existing small signal characteristics of the op-amp. They can also reduce die size requirements and technical limitations for improving unity gain op-amp designs.

Figure 5:
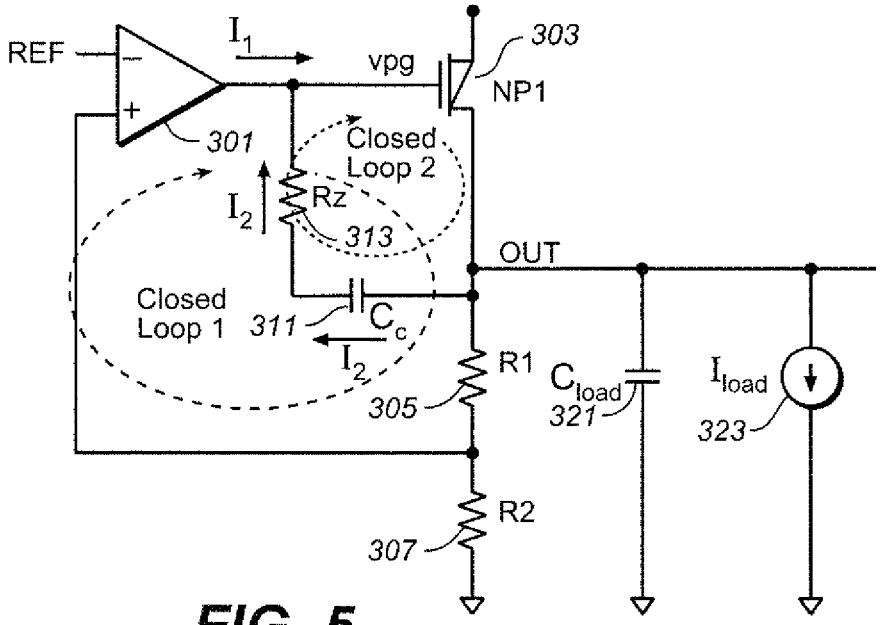
FIG. 5 illustrates the use of Miller capacitive compensation.

Some of the relevant concepts can be illustrated with respect to FIG. 5, which shows a fairly conventional implementation of Miller capacitive compensation. In FIG. 5, an op-amp 301 has an output voltage vpg and is connected to the gate of a power transistor NP1 303, which is connected between the high supply level and the output node to provide an output level OUT. The current output of the op-amp is represented as I1. The inputs of the op-amp 301 are a reference voltage level REF and feedback from OUT. The feedback is taken from a node of the resistive divider of R1 305 and R2 307 that are connected in series between OUT and ground. The load is represented by the capacitance Cload 321 and the current Iload 323. A first closed loop (Closed Loop 1) is the feedback loop from OUT back to the + input of the op-amp 301. The Miller capacitive compensation is represented by the capacitor Cc 311 and resistance Rz 313 connected in series between the OUT and vpg nodes, where these elements can be in the order shown or the other way around.

If the level at OUT is not disturbed by a large amount, closed loop 1 is the only closed loop in the feedback path of op-amp 301, allowing to all nodes to settle based on the dominant pole at the node vpg:

$$Pvpg=Rout1*Cc(1+Av),$$

where Av is the voltage gain of the op-amp and Rout1 is the drain-source resistance of NP1 303. Non-dominant poles arise from the output nodes and internal nodes of error amplifiers.

When the level at OUT is significantly disturbed (such as a large signal disturbance), then there are two closed loops existing at same time: Closed Loop 1 of the op-amp 301 as for small signals and also a fast Closed Loop 2 formed by Cc 311 and Rz 313. The criteria for the fast closed loop 2 to dominate over closed loop 1 are: $I2=(Vout-Vpg)(*Gz+j\omega Cc)$; and $I2>>I1$, where I2 is the current through this second closed loop and Gz is the conductance of Rz. In feedback theory, with these conditions, closed loop 2 will dominant over closed loop 1. In closed loop 2, the amplitude of disturbance could overwhelm error amplifier current capability, and as a result, the nodes can have long ringing and be slow to settle, causing oscillation of the entire network if Iload 323 is still changing and causing additional significant disturbance to closed loop 2, so that there is no dominant pole in the closed loops.

Figure 6:
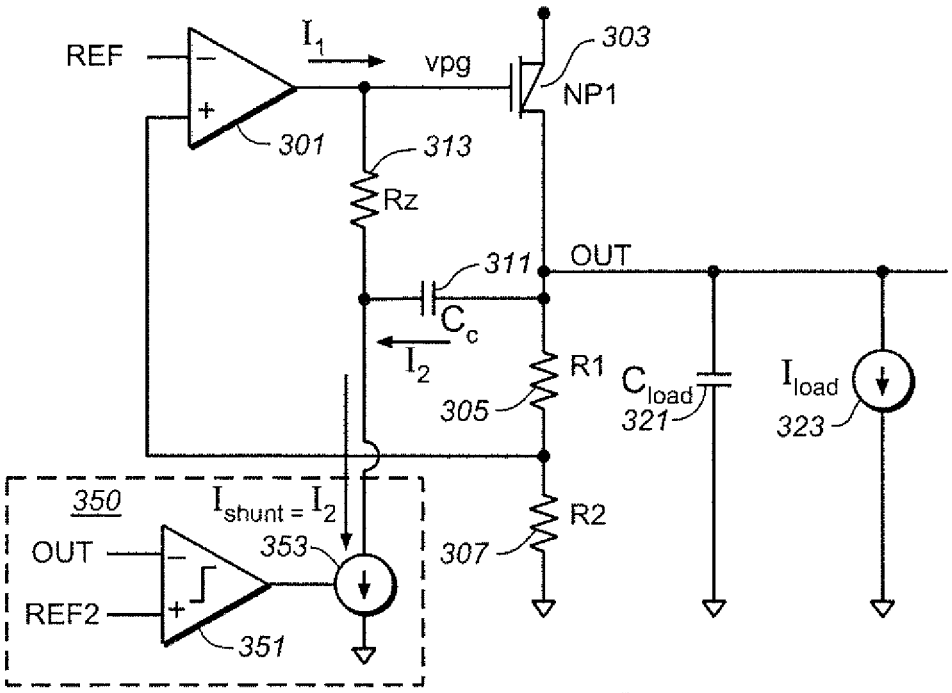
FIG. 6 is an exemplary embodiment of a circuit incorporating a shunting circuit into a circuit using Miller capacitive compensation.

FIG. 6 is an exemplary embodiment for circuitry to help overcome these problems. More specifically, shunting circuitry 350 is added to a circuit incorporating Miller capacitive coupling. A current sinking circuit 353, which can again be implemented as a transistor, is connected from a node in second closed loop between Rz 313 and Cc 311. Alternate, it could be connected at different point in the loop, such as above at Vpg, but this will typically reduce effectiveness. The current sink 353 is controlled by a comparator 351 whose inputs are the level on OUT and a reference value REF2. As indicated on FIG. 6, the preferred embodiment for the comparator 351 again digital for its quicker response. In this way, this can help to deal with situations when OUT is being pulled up strongly by some means (such as a steady state large load current suddenly being switched off, or some other circuits inject current into OUT).

The shunt path Ishunt from the other side of Cc 311 is enabled only when the circuit detects large downward transitions of OUT, which occur for large signal output drop, recovery or settling. The Ishunt current will add a positive feedback loop when output is dropping and is exceeding the large signal criteria by sourcing additional current from Vpg node. This helps to improve output recovery. During recovery the Ishunt current will cause the closed loop 2 to dominate over closed loop 1 during a recovery phase. By making $Ishunt \leq I2$, it will kill off the closed loop 2; or, if Ishunt does not completely offset I2, the remaining charge injected through Cc can be significantly lowered and closed loop 1 will dominate for the entire op-amp circuit without going into slewing or reduce the voltage to be slewed. As there is then only a closed loop, the entire closed loop 1 will settle based upon its own frequency response. If the phase margin of closed loop 1 is good, the circuit will settle properly with either critically damped results or with minor ringing to settle.

The reference voltage REF used by the error amplifier 301 and the reverence voltage REF2 used at the comparator 351 can be offset from each other by a margin to take care of several things. One of these is that it is preferable for the error amplifier 301 and the comparator 351 are not on at the same time in steady state. The difference between REF and REF2 is a margin to take care of the lumped input referred offset back to input of comparator 351 or error amplifier 301. In the circuit of FIG. 6, it is preferable to separate the operating regions (small signal vs. large signal) for the main LDO. The difference between REF and REF2 are used to differentiate those operating regions, where the offset could be something like 100-200 mV, for example. The pull down transistor of 353 is turned on when load is pulled up and before the LDO enters into the small signal region to take care of error amplifier slow slewing issues, while in steady state the comparator will not be on and there will no shunt current.

Consequently, the addition of the shunting section 350 can significantly increase settling speed and effective bandwidth of the circuit using Miller capacitive compensation. To achieve equivalent performance without this addition, existing designs need to consume more power to increase Band Width, which can be difficult or impossible due to technology limitations.

CONCLUSION

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application, to thereby enable others skilled in the art to best utilize the invention in various embodiments and with various modifications as are suited to the particular use contemplated. It is intended that the scope of the invention be defined by the claims appended hereto.

It is claimed:

1. A voltage regulation circuit, comprising:

a power transistor connected between an input supply voltage and an output supply node;

an error amplifier having a first input connected to receive a first reference voltage and a second input connected to a feedback node, the error amplifier providing an output derived therefrom connected to control the gate of the power transistor;

a voltage divider circuit connected between the output node and ground, the feedback node taken from a first node of the voltage divider;

a current source circuit connected between the input supply voltage and the output supply node; and a comparator having a first input connected to receive a second reference voltage and a second input connected to a second node of the voltage divider and derive a digital output therefrom, where an output of the comparator is connected to the current source circuit, where the magnitude of the current provided to the output supply node is based on the comparator's output.

2. The voltage regulation circuit of claim 1, wherein the current source circuit includes a transistor connected between the input supply voltage and the output supply node, and having a control gate connected to receive the comparator's output.

3. The voltage regulation circuit of claim 1, wherein the comparator is further connected to the current source circuit through a buffer.

4. The voltage regulation circuit of claim 1, wherein the second node of the voltage divider is intermediate between the output supply node and the first node of the voltage divider.

5. The voltage regulation circuit of claim 1, wherein the first and second reference voltages are of the same level.

6. The voltage regulation circuit of claim 1, wherein the first and second reference voltages are of different levels.

7. Voltage regulation circuitry for supplying a load on an integrated circuit, comprising:

a voltage generation section, including:

a power transistor connected between an input supply voltage and a first output supply node;

an error amplifier having a first input connected to receive a reference voltage and a second input connected to a feedback node, the error amplifier providing an output derived therefrom connected to control the gate of the power transistor; and a voltage divider circuit connected between the output node and ground, the feedback node taken from a node of the voltage divider, and a supplementary current source, including:

a current source circuit connected between the input supply voltage and a second output supply node, the load being connected between the first and second output supply nodes; and a comparator having a first input connected to the first output supply node and a second input connected to the second output supply node, the comparator deriving a digital output from the first and second inputs, and where the comparator's output is connected to the current source circuit, where the current provided to the second output supply node is based on the comparator's output.

8. The voltage regulation circuitry of claim 7, wherein the current source circuit includes a transistor connected between the input supply voltage and the second output supply node, and having a control gate connected to receive the comparator's output.

9. The voltage regulation circuitry of claim 7, wherein the comparator is connected to the current source circuit through a buffer.

* * * * *